US010791887B2

(12) United States Patent
Simmons et al.

(10) Patent No.: US 10,791,887 B2
(45) Date of Patent: Oct. 6, 2020

(54) PACKAGE OF DISPOSABLE WIPES

(71) Applicant: The Procter & Gamble Company, Cincinnati, OH (US)

(72) Inventors: John Norman Simmons, Cincinnati, OH (US); Lawrence Andrew Schumacher, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/538,862

(22) Filed: Aug. 13, 2019

(65) Prior Publication Data

US 2020/0046177 A1 Feb. 13, 2020

(30) Foreign Application Priority Data

Aug. 13, 2018 (EP) ..... 18188694

(51) Int. Cl.
*B65D 83/08* (2006.01)
*A47K 10/42* (2006.01)

(52) U.S. Cl.
CPC ..... *A47K 10/421* (2013.01); *B65D 83/0805* (2013.01); *B65D 83/0894* (2013.01)

(58) Field of Classification Search
USPC ..... 221/33–63
See application file for complete search history.

(56) References Cited

U.S. PATENT DOCUMENTS

2005/0189367 A1* 9/2005 Chasid ..... B65D 75/5838 221/35
2005/0205594 A1 9/2005 Evans
2009/0289078 A1 11/2009 Melin
2014/0001196 A1* 1/2014 Bushman ..... B65D 75/5833 221/45
2014/0367400 A1* 12/2014 Crudge ..... A47K 10/3818 221/1
2016/0000278 A1* 1/2016 Yamada ..... B65D 83/08 221/58

(Continued)

FOREIGN PATENT DOCUMENTS

EP 3018067 B1 4/2018
JP 01226579 A 9/1989

OTHER PUBLICATIONS

EP Search Report, 18188694.6, dated Oct. 1, 2019, 7 pages.

*Primary Examiner* — Gene O Crawford
*Assistant Examiner* — Ayodeji T Ojofeitimi
(74) *Attorney, Agent, or Firm* — Wednesday G. Shipp

(57) ABSTRACT

A disposable wipes package and a package for disposable wipes comprising improved fitments to aid removal of wipes from within a package is disclosed herein. The dispensing fitment is formed of a single material and comprises a frame for securing to a package of disposable wipes. The frame has an oval, rectangular, diamond or ring shaped rim with an internal wall defining an opening through which wipes may be dispensed. A first petal is provided having a free end extending into an opening from a first side of the frame. A second petal has a free end extending into an opening from a second side of the frame towards the first petal to define a gap between the free ends of the first and second petals. The opening includes the gap and one or more orifices and occupies between 40% and 90% of the area within the rim.

19 Claims, 10 Drawing Sheets

(56) References Cited

U.S. PATENT DOCUMENTS

| | | | | |
|---|---|---|---|---|
| 2016/0106273 | A1* | 4/2016 | Yamada | B65D 75/5877 221/1 |
| 2016/0113450 | A1* | 4/2016 | Yamada | A47K 10/423 221/1 |
| 2016/0143490 | A1* | 5/2016 | Yamada | A47K 10/185 221/1 |
| 2017/0150852 | A1 | 6/2017 | Park | |
| 2018/0160868 | A1 | 6/2018 | Ma | |

* cited by examiner

PACKAGE OF DISPOSABLE WIPES

FIELD OF THE INVENTION

The present invention is generally directed to a dispensing fitment for packages of disposable wipes moistened with a liquid composition (also known as "wet wipes") and to packages of disposable wipes incorporating a dispensing fitment.

BACKGROUND OF THE INVENTION

Wet wipes are currently sold for a variety of applications, including for use in personal cleansing in circumstances where soap, water, cloths, towels and a sink or washtub facility are unavailable or inconvenient. Wet wipes are also used for cleaning items other than human bodies, treating materials or surfaces, or delivering materials to a targeted area.

Wet wipes as packaged and sold typically comprise a stack of individually cut sheets, or a continuous folded stack or roll of material having perforations dividing the material into lengths that may be torn away at the perforations as individual sheets. The material of which the sheets are formed may be a nonwoven material formed of polymeric or natural fibers, or a combination thereof. The material is typically highly porous and capable of absorbing and holding a substantial fraction of its weight, or more, of a liquid composition. The stack or roll may be moistened or even saturated with the liquid composition. The liquid composition may be a solution or an emulsion, or a combination thereof, and may contain one or more cleansing agents, skin care agents, preservatives (antibacterial agents) and perfumes. As such, the wipes may constitute a convenient and pleasant product useful for a variety of personal cleansing applications, such as hand wipes, child wipes, baby wipes, etc.

One way in which wet wipes are packaged is within a flow-wrap film package. A polymer film having a suitably low water vapor transmission rate is selected and used to form stock package material. Wet wipes stacks are formed and conveyed to a flow wrapping machine, which wraps the stock package material about each stack and forms seams in the material to join it to itself and seal it about the stack, thereby forming a moisture-retaining package of wet wipes that is sufficient to retain the moisture content from the time of manufacture to the time of purchase. Once the wipes are removed, the package may be disposed of.

Packages for wet wipes may include some form of dispenser or fitment to facilitate practical dispensing. In this respect, users of wet wipes often extract wipes from the package using just one hand, particularly in the case where, for example, wipes are to be used on a baby. It is desirable for a user to be able to extract the wipes one at a time while also being able to reach inside the package should the wipes become stuck. This tension is solved in many durable containers for wet wipes by provided a plastic dispensing frame with an inner silicone (or other soft and flexible material) member that "grips" individual wipes as they are removed thus controlling removal of wipes, while still providing a soft web through which a user can reach to retrieve wipes. However, such solutions are typically costly and are thus not suitable for use on flexible disposable packaging where the fitment is disposed of, together with the packaging.

Thus, there is still a need for a low cost solution that facilitates consumer needs with regard to removal of disposable wet wipes from packaging.

SUMMARY OF EXEMPLARY FORMS

The present invention is directed to packages of substrates moistened with a liquid composition.

A dispensing fitment for securing to a package of disposable wipes having an opening through which wipes are dispensed is provided. The dispensing fitment is formed of a single material and comprises a frame for securing to a package of disposable wipes, the frame comprising: a rim; an internal wall defining an opening through which wipes may be dispensed; a first petal having a free end extending into the opening from a first side of the frame; a second petal having a free end extending into the opening from a second opposing side of the frame towards the first petal to define a gap between the free ends of the first and second petals, wherein the opening comprises the gap and one or more orifices and occupies between 40% and 95% of the area within the rim.

A package of disposable wipes is further provided, the package comprising: a package body comprising a weakened region to facilitate creation of a dispensing opening upon first use of the package of wipes; a plurality of stacked wipes; a dispensing fitment situated over the weakened region, the dispensing fitment being formed of a single material and comprising a frame for securing to a package of disposable wipes, the frame comprising: a rim; an internal wall defining an opening through which wipes may be dispensed; a first petal having a free end extending into the opening from a first side of the rim; a second petal having a free end extending into the opening from a second opposing side of the rim towards the first petal to define a gap between the free ends of the first and second petals, wherein the opening comprises the gap and one or more orifices and occupies between 40% to 95% of the area within the rim.

BRIEF DESCRIPTION OF THE DRAWINGS

The following detailed description of specific forms of the present invention can be best understood when read in conjunction with the drawings enclosed herewith.

DETAILED DESCRIPTION

Figure 1:
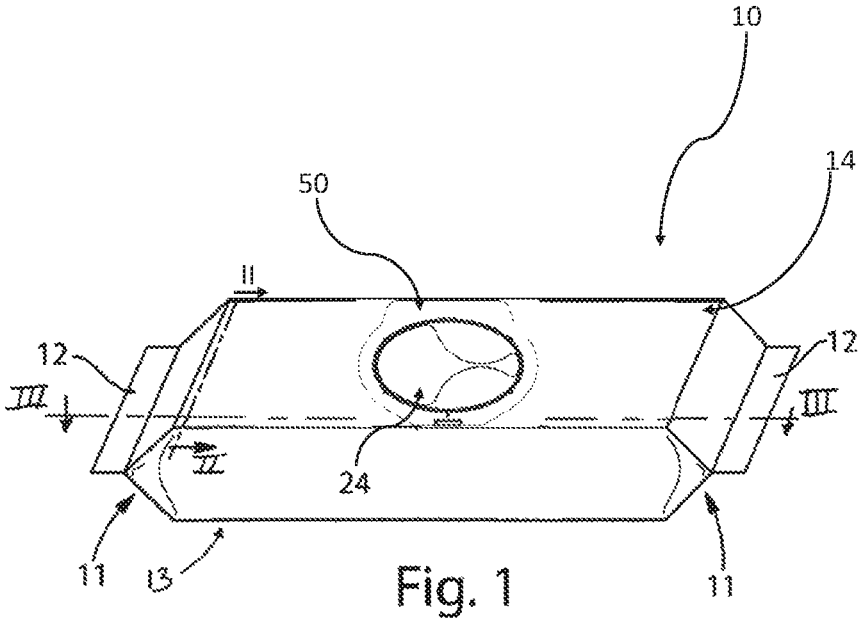
FIG. 1 is a perspective view of a package of wet wipes showing a fitment as described herein.
Figure 2:
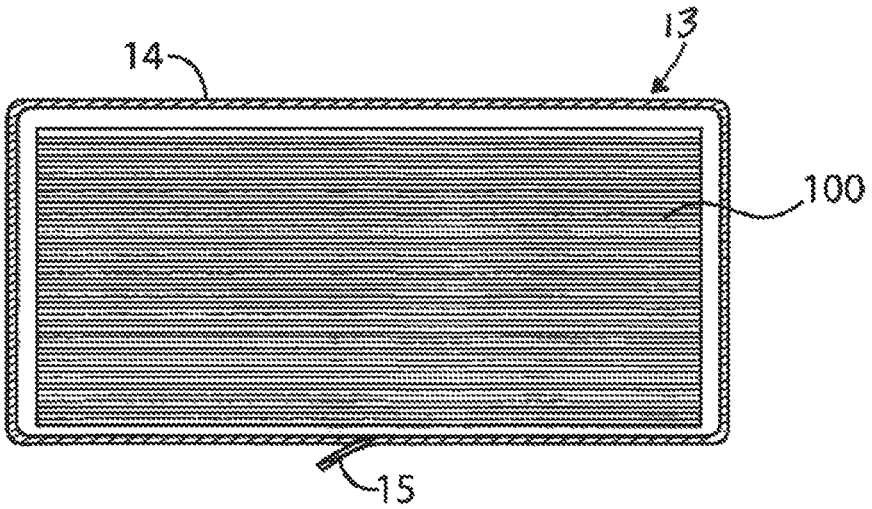
FIG. 2 is a cross-sectional view taken through II-II.
Figure 3:
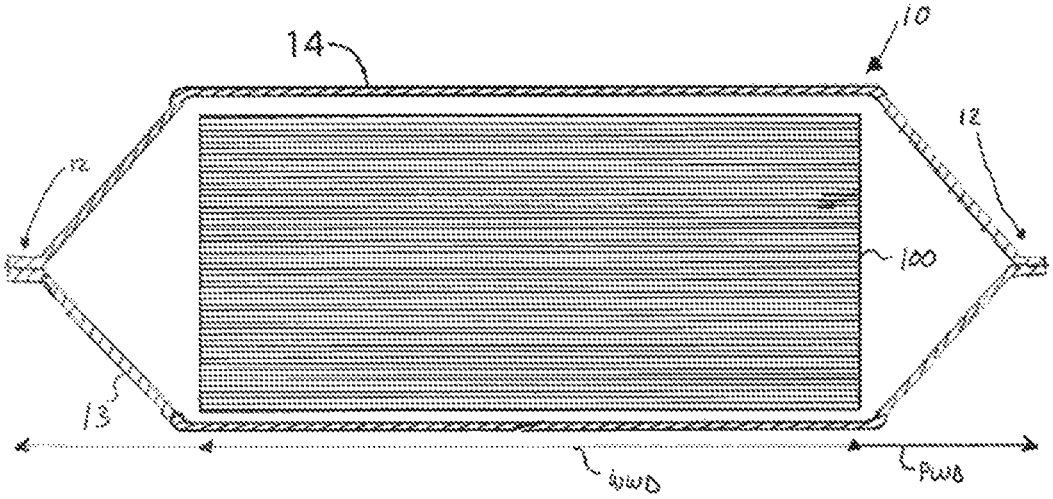
FIG. 3 is a cross-sectional view taken through III-III.

The present invention is generally directed to packages for disposable wipes. FIGS. 1-3 depict a wet wipes package 10. Wet wipes package 10 may contain a stacked supply of wipes 100 formed of a suitable substrate of nonwoven web material. The packages of the present invention are preferably configured for dispensing stacks of folded wipes and not a convolutely wound series of wipes. While the wipes may be connected and separated, for example via perforations, the stacked wipes are preferably discrete and not connected to one another. Instead, they are simply stacked on top of one another or partially nested with one another.

The wipes may be moistened with a liquid composition by the manufacturer or packager, or alternatively moistened by the end user after purchasing the package of substrates. A typical liquid composition comprises an aqueous lotion composition. The lotion compositions may contain more than 80%, 85%, 90%, 95%, or 98.5% by weight water (or other solvent).

Package 10 comprises a package body 13 formed of a flexible packaging material that encases a stack of wet wipes. Useful packaging materials can comprise polymeric films (one or more layers), paperstock, waxed paper, foils, fibrous webs (nonwovens, wovens), and combinations thereof. One particular packaging material example is a multi-layered polymeric film formed of one or more polyolefins, such as polypropylene or a blend of resins containing a predominate weight percentage of polypropylene for a first layer; and polyethylene or a blend of resins containing a predominant weight percentage of polyethylene for a second layer. In a non-limiting example, a layer formed predominately of polypropylene having a first relatively higher melting temperature, and a layer formed predominately of polyethylene having a second relatively lower melting temperature, may be used to form the outer and inner layers, respectively. A predominately polyethylene layer having a thickness of not less than 35 more preferably not less than 38 more preferably not less than 43 and still more preferably not less than 48 may form the inner layer. The outer layer may be a predominately polypropylene layer having a thickness of not less than 10 more preferably not less than 15 and still more preferably not less than 20 μm.

The selected packaging material may be unwound from a stock roll and passed in a longitudinal/machine direction into a flow-wrap machine, along with individual wipes stacks. The flow-wrap machine may be configured so as to wrap the packaging material stock longitudinally about each incoming stack, join the packaging material along its longitudinal edges to form a sealed fin seam 15 and a sleeve-like structure about the stack, tuck the packaging material at the ends to form tucks 11, and then crimp, seal and cut the packaging material between each stack, forming individual packages 10 of wipes having end seams 12. Other known methods of manufacturing flexible packages may be employed to make the packages described and claimed herein.

Figure 4:
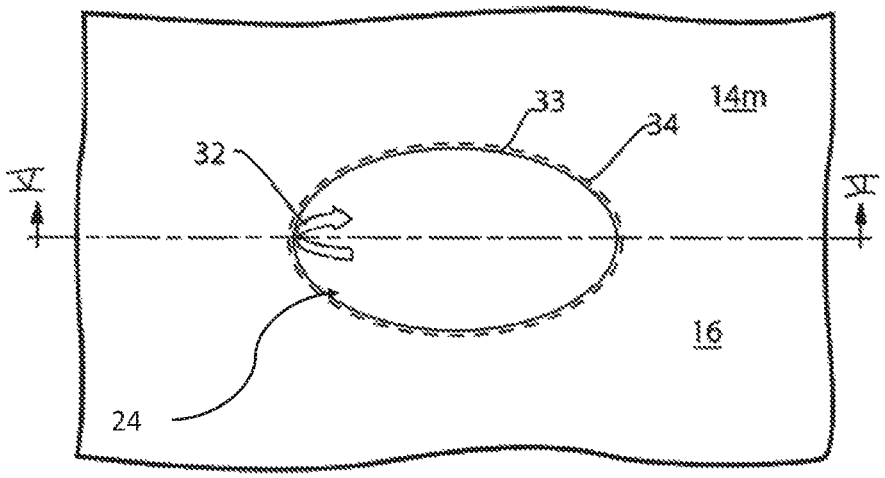
FIG. 4 shows a view from above of the wet wipes package incorporating a perforated opening through which wipes may be dispensed.

Referring now to FIG. 4, package 10 comprises a weakened region 24 that can be manipulated for providing access to the contained wipes. The weakened region 24 can be defined by a line of weakness 33 created by perforation, scoring, or embossing, for example. In one form, the packages comprise a weakened region having a boundary defined by a discontinuous line of laser score segments. Laser scoring may be performed using a laser light source, which may be selected by light frequency and power to penetrate the packaging material to a desired depth. Under certain circumstances, a laser may be selected and/or adjusted to score through one type of packaging material without substantially scoring through another.

Weakened region 24 may optionally comprise indicium to indicate the location of the weakened region and to instruct a consumer how to manipulate the same to create an opening access to the contained wipes. By way of example and with reference again to FIG. 4, weakened region 24 comprises laser score segments 33, a first indicium 34 to highlight the location and scope of weakened region 24, and a second indicium 32 to communicate removal of the weakened region upon manipulation of the same to create the access opening.

The shape characteristics of the weakened region 24 formed by the scored groove 33 may be deemed important. It may be preferable that the shape be selected from the group consisting of circle, oval, ovaloid, ellipse, egg-shape, rounded rectangle (rectangle with rounded corners), or any shape that lacks sharp corners. Alternatively, it may be preferable that the scored groove 33 include few or no sharp turns or corners, which can have the effect of localizing stresses that can promote tear propagation that strays beyond or outside of the groove. Thus, it may be preferred that the scored groove 33 does not include any curve having a radius less than 5 mm along any portion thereof. A circular, oval or elliptical shape may be more preferred, and an oval or elliptical shape most preferred. Additionally, it may be preferred that the selected shape have an aspect ratio of greatest dimension to smallest dimension not exceeding 4.0, more preferably not exceeding 3.0, more preferably not exceeding 2.5, and still more preferably not exceeding 2.0. This may help ensure that any curves in the scored outline are not so sharp as to concentrate tearing stresses to an extent that promotes propagation of tears that stray beyond or outside the scored groove 33. One or more of these characteristics may be important to reduce the possibility that a tear, initiated by the consumer attempting to create an access opening, will propagate outside or beyond the scored groove, resulting in a misshapen, unsightly opening, compromising the moisture-retaining functionality of the package, or simply frustrating the consumer.

A benefit of defining the weakened region with a line of weakness that does not extend all the way through one or more layers of the packaging material is to eliminate the need for an over-label seal to preserve the desired moistness level associated with the wipes before they are purchased and used for the first time. For example, some prior art wipe packages employed an applied adhesive-based sticker 31 to cover a weakened region created by perforated line comprising perforations 30 extending entirely through the thickness of the packaging material film 14. These applied adhesive-based stickers create additional waste. They can also be inadvertently obtained by babies/toddlers if not disposed of properly or if a baby/toddler is able to manipulate a closure fitment before the sticker is removed for the first time. Some forms of the present invention accordingly are devoid of an applied adhesive-backed sticker.

Figure 5:
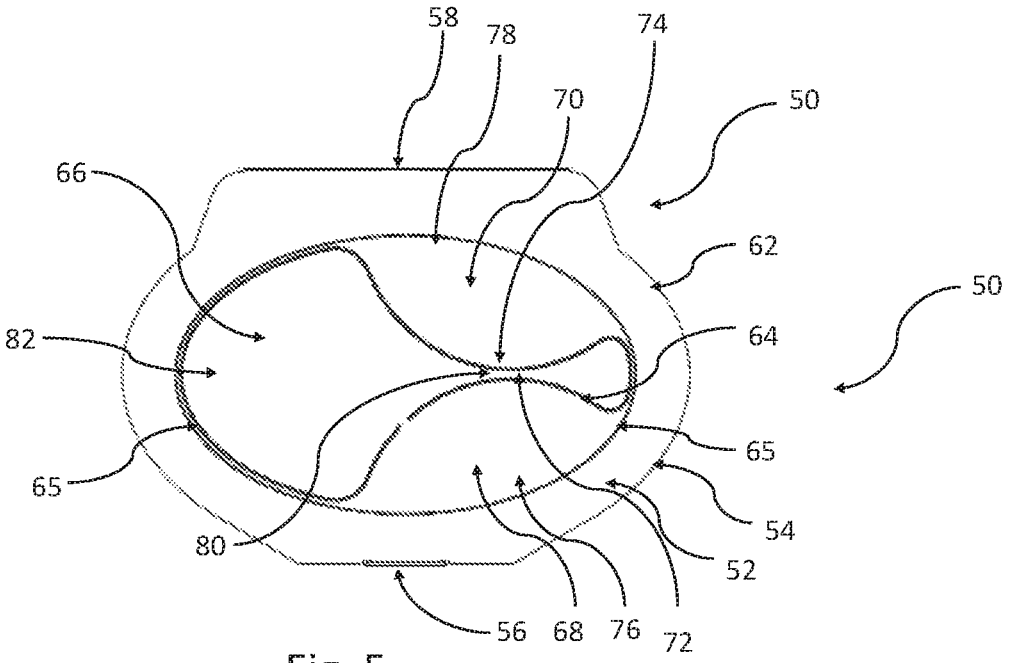
FIG. 5 is a view from above of the fitment, highlighting different features.
Figure 6:
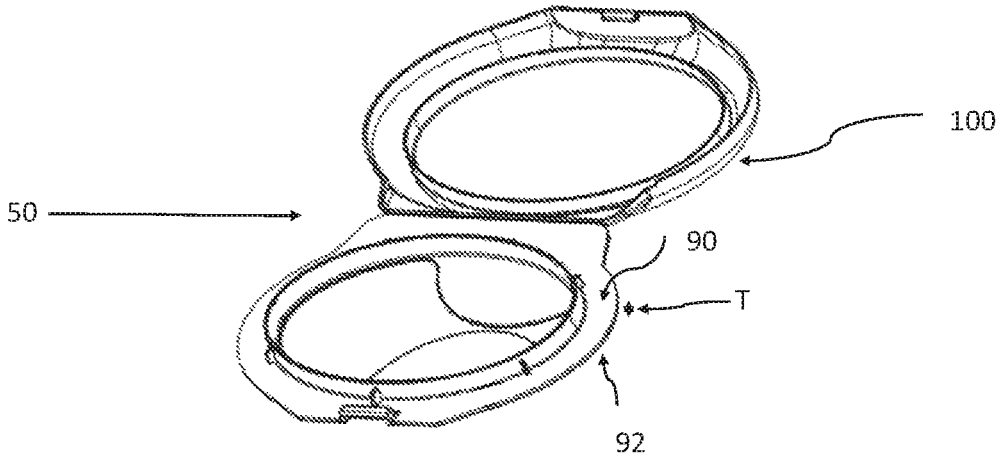
FIG. 6 is a perspective view of the fitment including lid.

Referring again to FIG. 1 and to FIG. 5, package 10 also comprises a dispensing fitment 50. The fitment comprises a substantially oval, diamond, rectangular or ring-shaped frame 52 having an external wall 54, an internal wall 64, first 56 and second 58 opposing elongate sides and third 60 and fourth 62 opposing short sides. The frame further has a rim 65 substantially parallel to the external wall and at least partially coterminous with the internal wall. The frame (as shown in FIG. 6) has a top surface 90 and a bottom surface 92 and an average thickness of between 0.5 mm to 3 mm, 0.75 mm to 2.5 mm, 1 mm to 2 mm, 1.25 mm to 1.75 mm, measured between the top surface and the bottom surface. The thickness of the frame is chosen based on the desired rigidity and cost. In use, the bottom surface of the frame may be adhered using known methods to a top surface of wipes packaging.

The internal wall 64 defines an opening 66 through which wipes may be dispensed. During use, the fitment 50 is located above the weakened region of a package of disposable wipes, with the contour of the weakened region preferably located under the frame (i.e., between the external wall and the internal wall of the frame). Where the length of the weakened region lies between the external wall and internal wall of the frame, wipes are removed across the entire length of the dispenser fitment, thus the entire opening 66 is available for withdrawal of wipes.

A first petal 68 extends into the opening 66 from a first side 56 of the frame. A second petal 70 extends into the opening 66 from the opposing second side 58 of the frame. The first and second petals 68, 70 each have a distal free end 72, 74 and a proximal tethered end 76, 78. A gap 80 is defined between the free ends 72, 74 of the first and second petals 68, 70 and one or more orifices 82 are provided between the gap 80 and the third and/or fourth side walls 60, 62 of the frame. The internal wall follows the contour of the first and second petals such that the opening 66 encompasses the gap 80 and one or more orifices 82. Preferably, the opening 66 occupies between 40% and 95%, 50% and 90%, 50% and 80%, 60% and 80%, 50% and 70% or 60% and 70% of the area within the rim 68.

Figure 7:
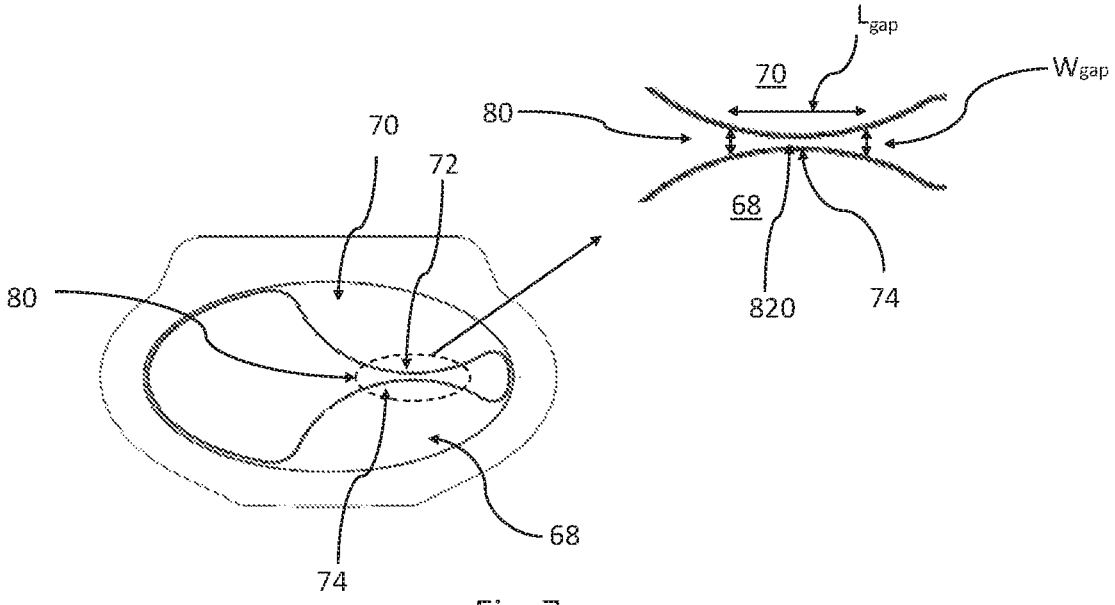
FIG. 7 is an enlarged view of the gap between the first and second petals enlarged.

As shown in FIG. 7, the gap 80 has a width $W_{gap}$ measured as the distance between the free ends 72, 74 of the first and second petals. Where the width varies across the gap, a pinch point 820 may be identified as the nearest points of the respective free ends of the first and second petals. The width has a maximum distance of between 0.5 mm and 8 mm, 0.75 mm and 7 mm, 1 mm and 6 mm, 1.25 mm and 6 mm, 1.5 mm and 5 mm, 1.75 mm and 4 mm or 2 mm and 3. The gap further has a length $L_{gap}$, orthogonal to the width where the distance between the petals is less than 4 times the width at the pinch point, or where there is no pinch point, less than 4 times the minimum width. For example, where the minimum width or the width at the pinch point is 1 mm, the length is calculated as that distance measured orthogonal to the width where the distance between the first and second petals does not exceed 4 mm. Preferably, the length of the gap is less than 60% of the overall length of the opening as measured between the third and fourth side walls of the frame. Preferably, the length of the gap between 60% and 10% or 50% and 15% or 40% and 20% or 30% and 25%.

The size of the gap influences the force exerted on wipes as they are removed from the pack through the dispenser. If the gap is too narrow, it becomes difficult to withdraw any wipes. If the gap is too wide, then multiple wipes may be removed at a time, leading to excess waste. A different width may be chosen dependent on the thickness of the wipes or any coatings applied to the wipes. For example, if a wipe has an oily coating, it will naturally be more lubricious and will pass through the gap more easily, in which case it would be preferable to have a narrower gap. Alternatively, if the wipes are thick and/or if no coating is applied, it may be preferable to have a wider gap.

It will be appreciated that additional petals may be provided while still providing the benefit of the invention described above. The presence of the gap (as described above) and the opening (described below) provide the attributes that allow wipes to be removed from within the package in a controlled manner.

The thickness of the first and second petals may be constant or it may vary from the proximal end to the distal end, notably become thinner towards to the free distal end. In this respect, manufacturing the dispensing fitment as a single injection molded piece may be easier where the thickness of the first and second petals tapers towards the respective free ends. The first and second petals have a thickness at the distal free end of from 0.2 mm to the maximum thickness of the frame. Preferably, the first and second petals have a thickness of from 0.2 mm to 1.4 mm, 0.3 mm to 0.9 mm, 0.4 mm to 0.8 mm, 0.5 mm to 0.7 mm, 0.5 mm to 0.6 mm. The first and second petals may have the same thickness profiles, alternatively, one petal may be thicker than the other. The thickness of the petals influences the flexibility of the petals, which in turn has an impact on the resistance the petals provide while withdrawing wipes through the dispenser. As with the gap width, the thickness of the petals may be modified to adjust to the needs of dispensers for different wipes. For example, for thin wipes, it may be preferable to have thicker first and second petals as they will typically be less flexible and will therefore apply more resistance as wipes are removed.

The first and second petals preferably have a rounded edge, thus reducing the chances that wipes will get torn as they are pulled through the gap.

Figure 8:
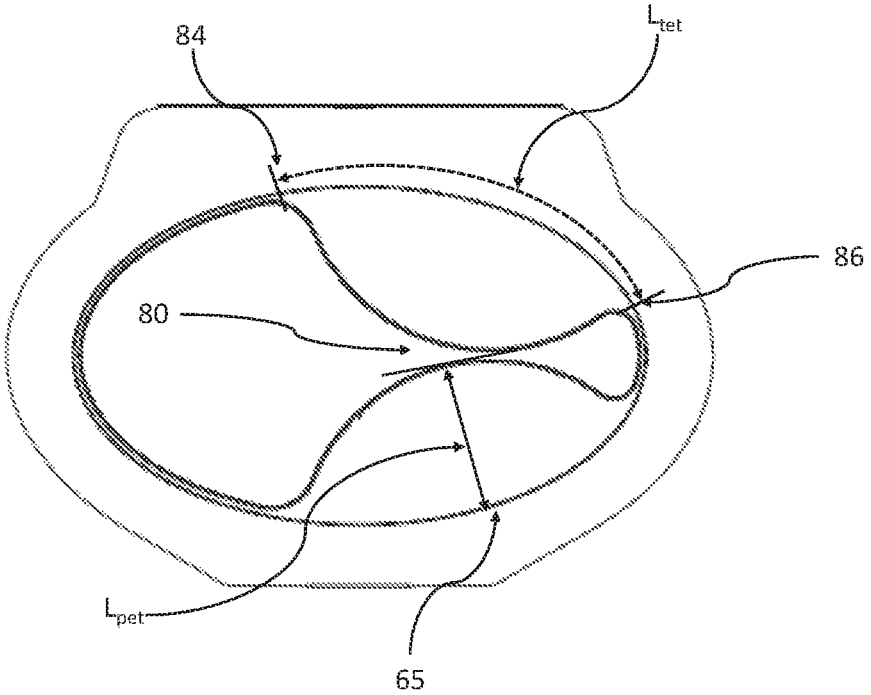
FIG. 8 is the view of FIG. 5 showing additional features.

Other factors that may contribute to the flexibility or rigidity of the respective petals include the petal lengths, the tethered length, and other structural features applied to the first and second petals. Ultimately, the petal length will likely be determined by the overall size of the frame and the required size of gap between the first and second petal. However, it may be possible to control flexibility of the petals by providing first and second petals of different lengths. For example, if the first petal is longer than the second petal, the first petal may be more flexible than the second petal. As shown in FIG. 8, the petal length $L_{pet}$ is calculated as the distance from the internal wall at the pinch point to the rim measured in a direction orthogonal to a tangent of the internal wall. The length of the first and second petals may be equal or alternatively, the first and second petals may have different lengths. The tethered length $L_{tet}$ of the first and second petals may also be used to control flexibility of the petals. The tethered length defines the distance where the petal is joined to the rim and is measured between the two points 84, 86 where the internal wall deviates from the rim for each of the first and second petals. If the tethered length of a petal is relatively short, the petal will likely be more flexible (assuming all other factors such as petal length and thickness remain the same). Conversely, to reduce flexibility of the petal, it may be desirable to anchor it along a greater portion of the rim, thus increasing the tethered length. Again, the tethered length of the first and second petals may be the same or different, dependent on different requirements. Preferably, the tethered length of each petal is between 10% and 35%, or 15% and 30% or 30% and 25% of the total circumference of the rim.

Figure 9A:
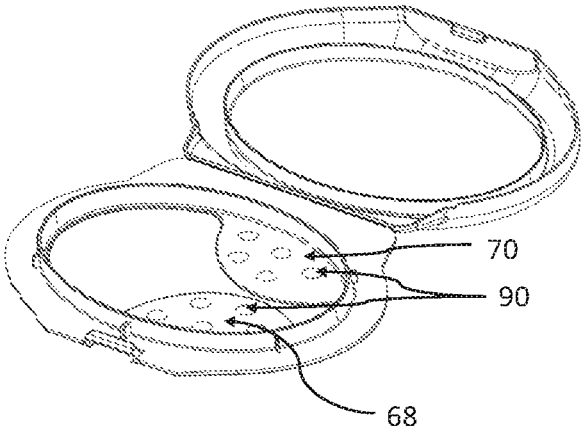
FIGS. 9A and 9B show alternative petal structures.
Figure 9B:
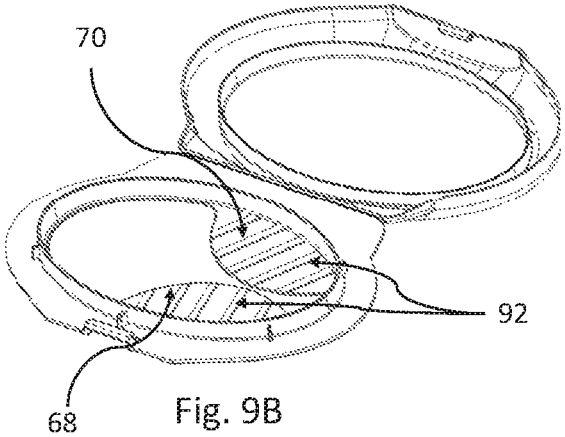
Figure 10A:
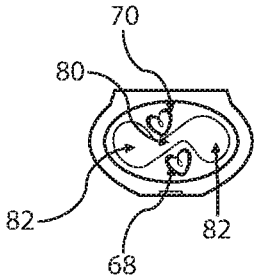
FIGS. 10A, 10B, 10C and 10D show alternative fitment structures.
Figure 10B:
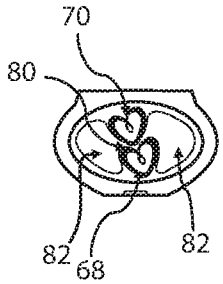
Figure 10C:
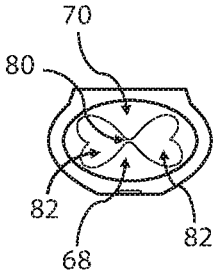
Figure 10D:
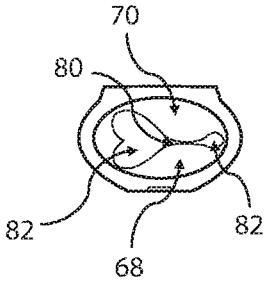

The first and second petals may comprise different structural features as shown in FIGS. 9A and 9B. for example, the first and second petals of FIG. 9A incorporate a plurality of circles 90. The provision of circles, i.e., the absence of material at these points, leads to more flexible petals. FIG. 9B shows first and second petals with a plurality of struts 92 that may be used to reinforce the petals making them less flexible. It will be appreciated that although a plurality of circles is shown, a single circle or a single strut may also be provided to modify the structural properties of the petals. Furthermore, the first and second petals may comprise different structural features or one may comprise structural features while the other does not.

As shown in FIG. 5, one or more orifices 82 may be provided in the opening alongside the first and second petals. The shape and size of the orifices will be determined by the shape and size of the petals. At least one orifice is required to enable users to insert their fingers, or one finger and a thumb, to remove the seal from the flexible package and then to withdraw wipes from within the pack. Preferably, at least one orifice provided has an area of at least 300 $mm^2$, preferably 350 $mm^2$, preferably 400 $mm^2$. FIGS. 10A, 10B, 10C and 10D show different examples of petal shapes and orifice shapes and sizes. As shown specifically in FIGS. 10A, 10B, 10C and 10D, where more than one orifice is provided, the gap between the first and second petals may be provided in approximately the center of the area within the rim. In an alternative embodiment, shown in FIG. 10D, at least one large orifice is provided offset from the center of the area within the rim. By providing one larger orifice, it maximizes the open area available for a user to reach through to remove the seal and/or to remove wipes. Thus, in an embodiment, the frame has a longitudinal axis and a latitudinal axis, intersecting in the center of the frame, wherein more than 50% of at least one orifice is located on one side of the latitudinal axis and more than 50% of the gap is provided on the other side of the latitudinal axis.

Preferably, at least 40%, 50% or 60% of the external perimeter of the at least one large orifice is coterminous with the rim. Thus, it is possible for a user to reach the weakened region and break the seal and remove it from underneath the dispenser fitment.

As shown in FIG. 6, the dispensing fitment may further comprise a lid 100, hingedly connected to the frame to enable the opening to the wipes packaging to be closed. One or both of the lid and frame may optionally be provided with lip, rim, groove, gasket, etc., cooperating sealing features such that, when the lid is in a closed position, the cooperating sealing features of lid and/or frame are in close proximity or effective contact with the other of the lid and/or frame about the perimeter of the lid, so as to retard the passage of moisture between the lid and the base. Preferably the length of the fitment rim 65 as measured substantially parallel to a longitudinal axis of the frame is less than the length of the weakened region of the package body when measured along the same axis. Thus, the weakened region extends beyond the fitment rim such that the opening through which wipes may be dispensed spans the entire length of the fitment. Furthermore, the length of the external wall of the frame, when measured in a direction substantially parallel to the longitudinal axis of the frame, may be longer than the length of the weakened region. Thus, the frame sits above the periphery of the weakened region in at least the length direction.

The fitment may be formed of a polymer such as a polyolefin, or polypropylene, for example polypropylene, low density polyethylene, PET or TPE and may be formed of a one shot molding process. Where the fitment comprises a lid and frame, both may be formed during the same one shot molding process. Providing the entire fitment as a one shot molding process enables an affordable fitment that still provides the required benefits of gripping wipes (through the gap between the first and second petals) and providing an open area (the orifice) through which an internal sealed portion of the wipes packaging may be removed and wipes retrieved.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular forms of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

A. A dispensing fitment for securing to a package of disposable wipes having an opening through which wipes are dispensed, the dispensing fitment being formed of a single material and comprising a frame for securing to a package of disposable wipes, the frame comprising:

a. a rim;

b. an internal wall defining an opening through which wipes may be dispensed;

c. a first petal having a free end extending into the opening from a first side of the frame;

d. a second petal having a free end extending into the opening from a second opposing side of the frame towards the first petal to define a gap between the free ends of the first and second petals, wherein the opening comprises the gap and one or more orifices and occupies between about 40% and about 95% of the area within the rim.

B. A dispensing fitment as described in paragraph A, wherein the gap has a width measured between the free ends of the first and second petals and has a maximum distance of between about 0.5 mm and about 6 mm.

C. A dispensing fitment as described in paragraph A, wherein the gap has a length measured in a direction orthogonal to the width, wherein the length is measured across the area where the width of the gap is less than 4 times the minimum width, and the length of the gap is less than about 60% of the overall length of the opening.

D. A dispensing fitment as described in paragraph A, wherein the first and second petals have a thickness of between about 0.2 mm and the thickness of the frame.

E. A dispensing fitment as described in paragraph A, wherein the thickness of one or both of the first and second petals varies from the rim to the respective free ends.

F. A dispensing fitment as described in paragraph A, wherein one or both of the first or second petals comprises one or more holes.

G. A dispensing fitment as described in paragraph A, wherein one or both of the first or second petals comprises one or more struts.

H. A dispensing fitment as described in paragraph A, wherein the first and second petals each have a tethered length extending along the rim, wherein the tethered length of one or both of the first and second petals is between about 10% and about 35% of the total circumference of the rim.

I. A dispensing fitment as described in paragraph A, wherein at least one of said orifices has an area of at least about 300 $mm^2$.

J. A dispensing fitment as described in paragraph A, wherein the frame has a longitudinal axis and a latitudinal axis, intersecting in the center of the frame, wherein more than about 50% of the orifice is disposed on one side of the latitudinal axis and more than about 50% of the gap is disposed on the other side of the latitudinal axis.

K. A dispensing fitment as described in paragraph A, wherein at least about 40% of the external perimeter of the at least one orifice is coterminous with the rim.

L. A dispensing fitment as claimed in any preceding claim, wherein the fitment is formed of polypropylene.

M. A package of disposable wipes, the package comprising:

a. a package body comprising a weakened region to facilitate creation of a dispensing opening upon first use of the package of wipes;

b. a plurality of stacked wipes, c. a dispensing fitment situated over the weakened region, the dispensing fitment being formed of a single material and comprising a frame for securing to a package of disposable wipes, the frame comprising:

i. a rim;

ii. an internal wall defining an opening through which wipes may be dispensed;

iii. a first petal having a free end extending into the opening from a first side of the rim;

iv. a second petal having a free end extending into the opening from a second opposing side of the rim towards the first petal to define a gap between the free ends of the first and second petals, wherein the opening comprises the gap and one or more orifices and occupies between about 40% and 90% of the area within the rim.

N. A package of disposable wipes as described in paragraph M, wherein a length of the rim as measured substantially parallel to the longitudinal axis of the frame is less than a length of the weakened region of the package body.

O. A package of disposable wipes as described in paragraph M, wherein the frame further comprises an external wall substantially parallel to the rim, wherein the length of the weakened region is less than a length of the external wall.

What is claimed is:

1. A dispensing fitment for securing to a package of disposable wipes having an opening through which wipes are dispensed, the dispensing fitment being formed of a single material and comprising a frame for securing to a package of disposable wipes, the frame comprising:

a. a rim;

b. a top surface and a bottom surface and an average thickness measured between the top surface and the bottom surface;

c. an internal wall defining an opening through which wipes may be dispensed;

d. a first petal having a free end extending into the opening from a first side of the frame;

e. a second petal having a free end extending into the opening from a second opposing side of the frame towards the first petal to define a gap between the free ends of the first and second petals, wherein the gap comprises a width $W_{gap}$ measured between the free ends of the first and second petals, wherein the opening comprises the gap and one or more orifices and occupies between 40% and 95% of the area within the rim: and wherein one or both of the first or second petals comprises one or more struts.

2. The dispensing fitment of claim 1, wherein the width has a maximum distance of 0.5 mm to 6 mm.

3. The dispensing fitment of claim 1, wherein the width gap $W_{gap}$ comprises a minimum width, and wherein the gap comprises a length $L_{gap}$ measured in a direction orthogonal to the width and only across the area where the width $W_{gap}$ of the gap is less than 4 times the minimum width of the gap, and wherein the length $L_{gap}$ is less than 60% of an overall length of the opening.

4. The dispensing fitment of claim 1, wherein the first and second petals each have a thickness between 0.2 mm and the average thickness of the frame.

5. The dispensing fitment of claim 1, wherein a thickness of one or both of the first and second petals varies from the rim to the respective free ends.

6. The dispensing fitment of claim 1, wherein one or both of the first or second petals comprises one or more holes.

7. The dispensing fitment of claim 1, wherein the first and second petals each have a tethered length $L_{tet}$ extending along the rim, wherein the tethered length $L_{tet}$ of one or both of the first and second petals is between 10% and 35% of the total circumference of the rim.

8. The dispensing fitment of claim 1, wherein at least one orifice has an area of at least 300 $mm^2$.

9. The dispensing fitment of claim 1, wherein the frame has a longitudinal axis and a latitudinal axis, intersecting in the center of the frame, wherein more than 50% of one of the one or more orifices is disposed on one side of the latitudinal axis and more than 50% of the gap is disposed on the other side of the latitudinal axis.

10. The dispensing fitment of claim 1, wherein at least 40% of an external perimeter of at least one orifice is coterminous with the rim.

11. The dispensing fitment of claim 1, wherein the fitment is formed of polypropylene.

12. A package of disposable wipes, the package comprising:

a. a package body comprising a weakened region to facilitate creation of a dispensing opening upon first use of the package of wipes;

b. a plurality of stacked wipes, c. a dispensing fitment situated over the weakened region, the dispensing fitment being formed of a single material and comprising a frame for securing to a package of disposable wipes, the frame comprising:

i. a rim having a total circumference;

ii. an internal wall defining an opening through which wipes may be dispensed;

iii. a first petal having a free end extending into the opening from a first side of the rim;

iv. a second petal having a free end extending into the opening from a second opposing side of the rim towards the first petal to define a gap between the free ends of the first and second petals, wherein the opening comprises the gap and one or more orifices and occupies between 40% and 95% of the area within the rim and wherein one or both of the first or second petals comprises one or more struts.

13. The package of disposable wipes of claim 12, wherein a length of the rim as measured substantially parallel to a longitudinal axis of the frame is less than a length of the weakened region of the package body.

14. The package of disposable wipes of claim 12, wherein the frame further comprises an external wall substantially parallel to the rim, wherein a length of the weakened region is less than a length of the external wall.

15. The package of disposable wipes of claim 12 further comprising a lid hingedly attached to the fitment.

16. The package of disposable wipes of claim 12, wherein the fitment is formed of polypropylene.

17. The package of disposable wipes of claim 12, wherein at least 40% of an external perimeter of at least one orifice is coterminous with the rim.

18. The package of disposable wipes of claim 12, wherein at least one orifice has an area of at least 300 $mm^2$.

19. A dispensing fitment for securing to a package of disposable wipes having an opening through which wipes are dispensed, the dispensing fitment being formed of a single material and comprising a frame for securing to a package of disposable wipes, the frame comprising:

a. a rim;

b. a top surface and a bottom surface and an average thickness measured between the top surface and the bottom surface;

c. an internal wall defining an opening through which wipes may be dispensed;

d. a first petal having a free end extending into the opening from a first side of the frame;

e. a second petal having a free end extending into the opening from a second opposing side of the frame towards the first petal to define a gap between the free ends of the first and second petals, wherein the first and second petals each have a tethered length $L_{tet}$ extending along the rim, wherein the tethered length $L_{tet}$ of one or both of the first and second petals is between 10% and 35% of the total circumference of the rim and wherein one or both of the first or second petals comprises one or more struts.

* * * * *